US010322331B2

(12) United States Patent
Aanes et al.

(10) Patent No.: US 10,322,331 B2
(45) Date of Patent: Jun. 18, 2019

(54) SYSTEM FOR OPTIONAL DYNAMIC POSITIONING A SKI BINDING

(71) Applicant: ROTTEFELLA AS, Klokkarstua (NO)

(72) Inventors: Øyvind Aanes, Drammen (NO); Thomas Goverud-Holm, Hoff (NO); Øyvar Svendsen, Oslo (NO); Håkon Johan Seiness, Kongsberg (NO); Øivind Grønli, Krokstadelva (NO); Odd Øystein Ra, Kongsberg (NO); Even Wøllo, Naersnes (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 15/557,406

(22) PCT Filed: Mar. 4, 2016

(86) PCT No.: PCT/NO2016/050038

§ 371 (c)(1),
(2) Date: Sep. 11, 2017

(87) PCT Pub. No.: WO2016/144187

PCT Pub. Date: Sep. 15, 2016

(65) Prior Publication Data

US 2018/0264349 A1 Sep. 20, 2018

(30) Foreign Application Priority Data

Mar. 12, 2015 (NO) ..... 20150320

(51) Int. Cl.
*A63C 9/00* (2012.01)
*A63C 9/08* (2012.01)
(Continued)

(52) U.S. Cl.
CPC ..... *A63C 9/0802* (2013.01); *A63C 9/086* (2013.01); *A63C 9/0807* (2013.01);
(Continued)

(58) Field of Classification Search
CPC ..... A63C 9/00; A63C 9/08528; A63C 9/0807; A63C 9/0802; A63C 9/086; A63C 9/0885; A63C 2009/008
See application file for complete search history.

(56) References Cited

U.S. PATENT DOCUMENTS 3,710,881 A * 1/1973 Thompson ..... A63C 5/085 180/181
3,964,560 A * 6/1976 Husted ..... A63C 5/085 180/181

(Continued)

FOREIGN PATENT DOCUMENTS

| | | | |
|---|---|---|---|
| EP | 2281615 | A2 | 2/2011 |
| WO | WO-88-04563 | A1 | 6/1988 |
| WO | WO-0213924 | A1 | 2/2002 |

OTHER PUBLICATIONS

International Search Report (In English) and Written Opinion (in English) of the International Searching Authority issued in PCT/NO2016/050038, dated Jun. 15, 2016, ISA/EPO, Rijswijk.

(Continued)

*Primary Examiner* — Bryan A Evans
(74) *Attorney, Agent, or Firm* — Harness, Dickey & Pierce, P.L.C.

(57) ABSTRACT

The present invention concerns a system for optional dynamic positioning of a ski binding (2) or parts of this, on or in a ski during use. The invention is characterized in that the system comprises an electrical actuator (6), an energy source (7) in order to run the electrical actuator, in addition to a control system (8) adapted to control the electrical actuator.

16 Claims, 6 Drawing Sheets

(51) Int. Cl.
*A63C 9/086* (2012.01)
*A63C 9/088* (2012.01)

(52) U.S. Cl.
CPC ..... *A63C 9/0885* (2013.01); *A63C 2009/008* (2013.01); *A63C 2203/12* (2013.01); *A63C 2203/18* (2013.01)

(56) References Cited

U.S. PATENT DOCUMENTS

| | | | | |
|---|---|---|---|---|
| 8,453,769 | B2 * | 6/2013 | Martel | B62D 51/007 180/9.22 |
| 8,844,664 | B1 * | 9/2014 | Decker, Jr. | B62M 27/02 180/181 |
| 8,910,967 | B2 * | 12/2014 | Bjertnaes | A63C 9/003 280/611 |
| 2007/0228695 | A1 | 10/2007 | Miette | |

OTHER PUBLICATIONS

International Preliminary Examination Report (Chapter II of the Patent Cooperation Treaty) with 13 annexed sheets, dated Mar. 7, 2017; IPEA/EP.
Norwegian Search Report issued in NO-20150320, dated Aug. 12, 2015.

* cited by examiner 11
12
15
16
17
19
20

SYSTEM FOR OPTIONAL DYNAMIC POSITIONING A SKI BINDING

CROSS REFERENCE TO RELATED APPLICATIONS

This application is a U.S. National Phase Application under 35 U.S.C. 371 of International Application No. PCT/NO2016/050038 filed on Mar. 4, 2016 and published in English as WO 2016/144187 A1 on Sep. 15, 2016. This application is based on and claims the benefit of priority from Norwegian Patent Application No. 20150320 filed Mar. 12, 2015. The entire disclosures of all of the above applications are incorporated herein by reference.

FIELD

The present invention concerns a system for optional dynamic positioning of a ski binding on a ski during use to improve an athlete's performance and user experience.

BACKGROUND

In U.S. Pat. No. 8,910,967 changing the position of a cross-country or touring binding in a longitudinal direction by means of a manual actuator is described. The publication addresses the advantages by being able to change the position of a binding on a ski to improve an athlete's performance and user experience. By moving the binding forward respective to the neutral position, the athlete will notice that the hold or grip of the surface become better. This is primarily due to that it becomes easier for the athlete to push the wax zone of the ski down onto the surface. By moving the binding backwards respective to the neutral position, the hold or grip will become poorer, but the ski will glide easier and faster. According to U.S. Pat. No. 8,910,967 the advantages are achieved by moving the binding forwards and backwards by a manually operable and actuatable lever or turning knob which cause the binding to be moved between two or more longitudinal positions on the ski via a toothed wheel or other toothed element.

Although U.S. Pat. No. 8,910,967 concerns a solution that offers several advantages there are also some disadvantages and problems. The main problem is that the athlete must stop completely, or at least bend down while moving, in order to reach the lever or turning knob and operate these. This is a major disadvantage during competitions, as time is lost and stiffness may be gained if the rhythm is interrupted. Similarly, it will be impractical to operate the lever or the turning knob often, even if this is desired. If the character of the terrain varies, e.g. in that it is a hilly trail or terrain, the optimal solution would be to change the position of the binding before and after each hill. Based on this, U.S. Pat. No. 8,910,967 is most suited for a trail or a usage area where it is unnecessary or undesirable to adjust the position of the binding often.

EP2281615A1 relates to a randoneé binding provided with a remotely controlled climbing wedge comprising an engine which helps the user to find a level, horizontal position on the skis while ascending up steep grades. The steepness may vary greatly, and with conventional manual systems with discreet mechanical heel positions, it is difficult and cumbersome to find the right position, especially since the right position changes continuously. EP2281615A1 proposes use of a climbing wedge which can be dynamically and remotely controlled/adjusted during use.

WO0213924A1 relates to a remote controlled, electrically actuated release mechanism intended as a supplement to the conventional mechanical release system.

SUMMARY

The purpose of the present invention is therefore to provide a solution which is not encumbered with the above-mentioned disadvantages.

BRIEF DESCRIPTION OF THE DRAWINGS

Below a non-limiting description of advantageous embodiments is provided with reference to the drawings, in which.

DETAILED DESCRIPTION

Figure 1A:
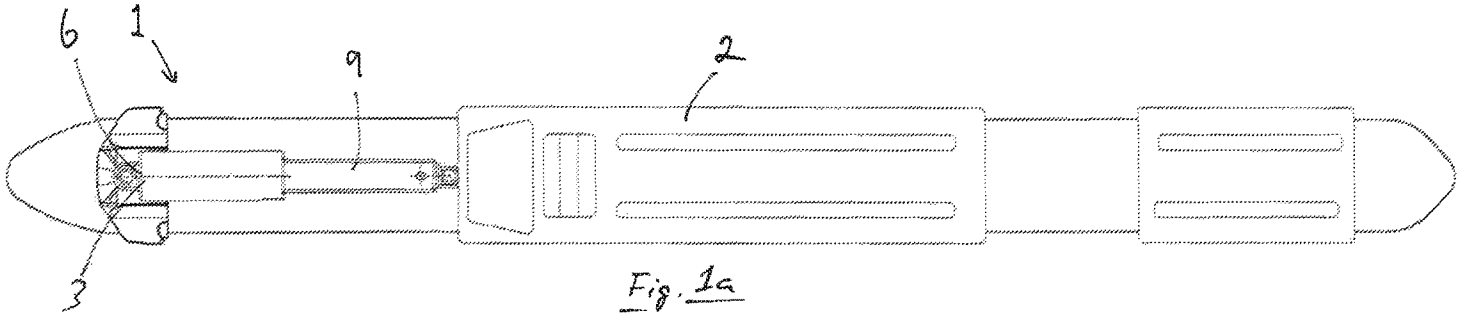
FIG. 1*a-c* shows a view of a possible embodiment of the present invention in various usage positions.
Figure 1B:
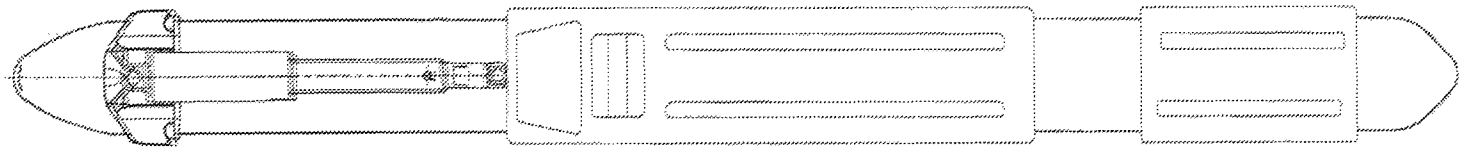
Figure 1C:
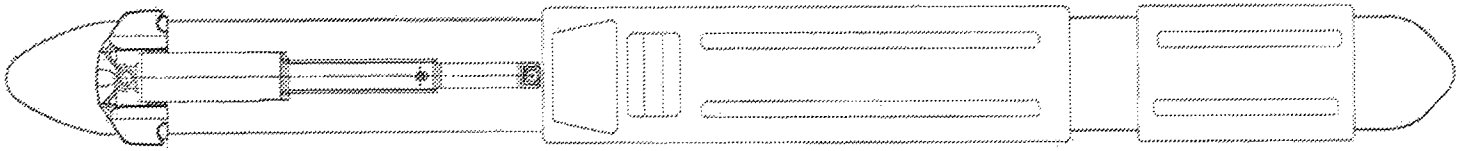
Figure 2:
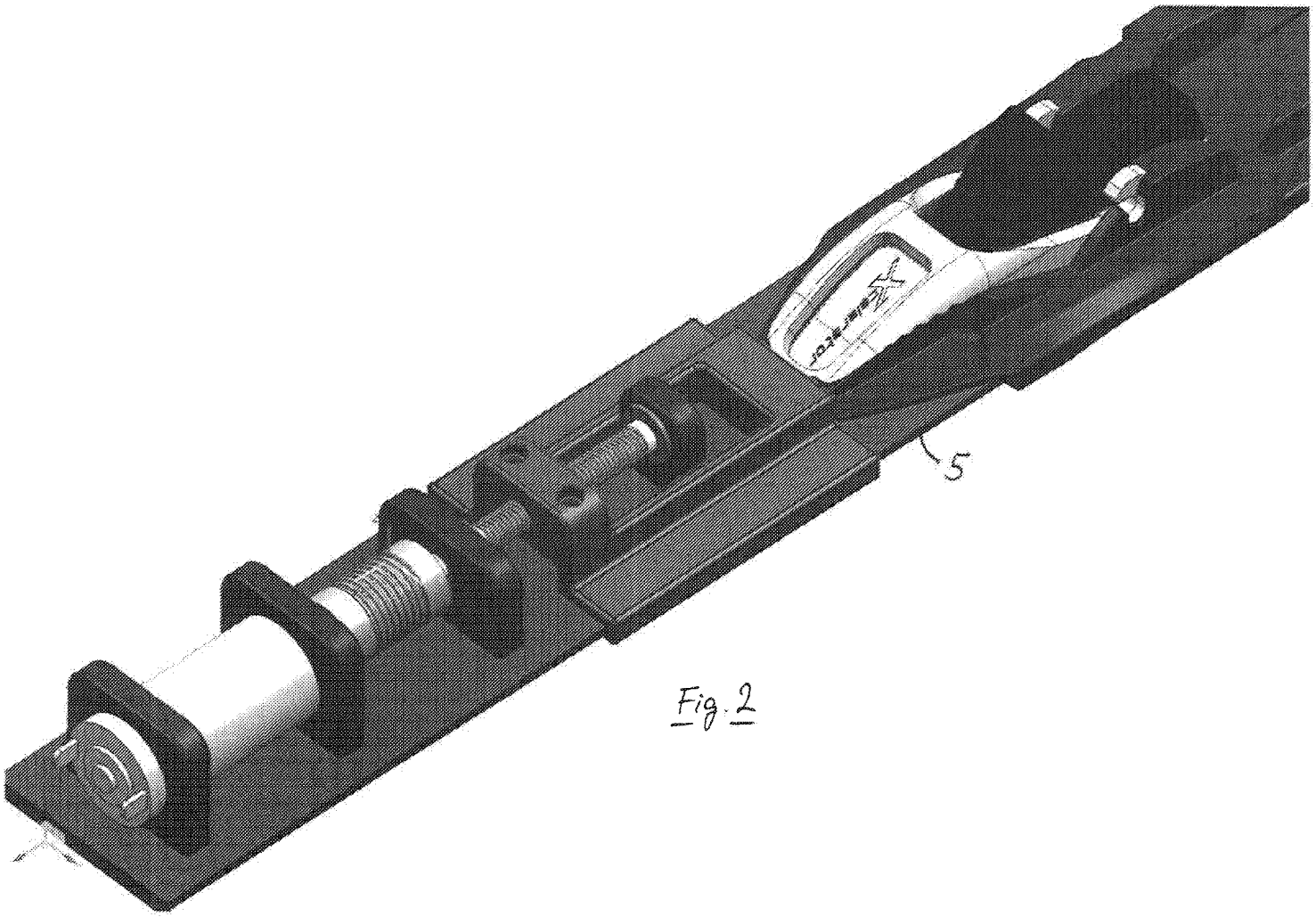
FIG. 2 shows a perspective view of an embodiment which resembles the embodiment in FIG. 1*a-c,*
Figures 3A, 3B, 3C, 3D:
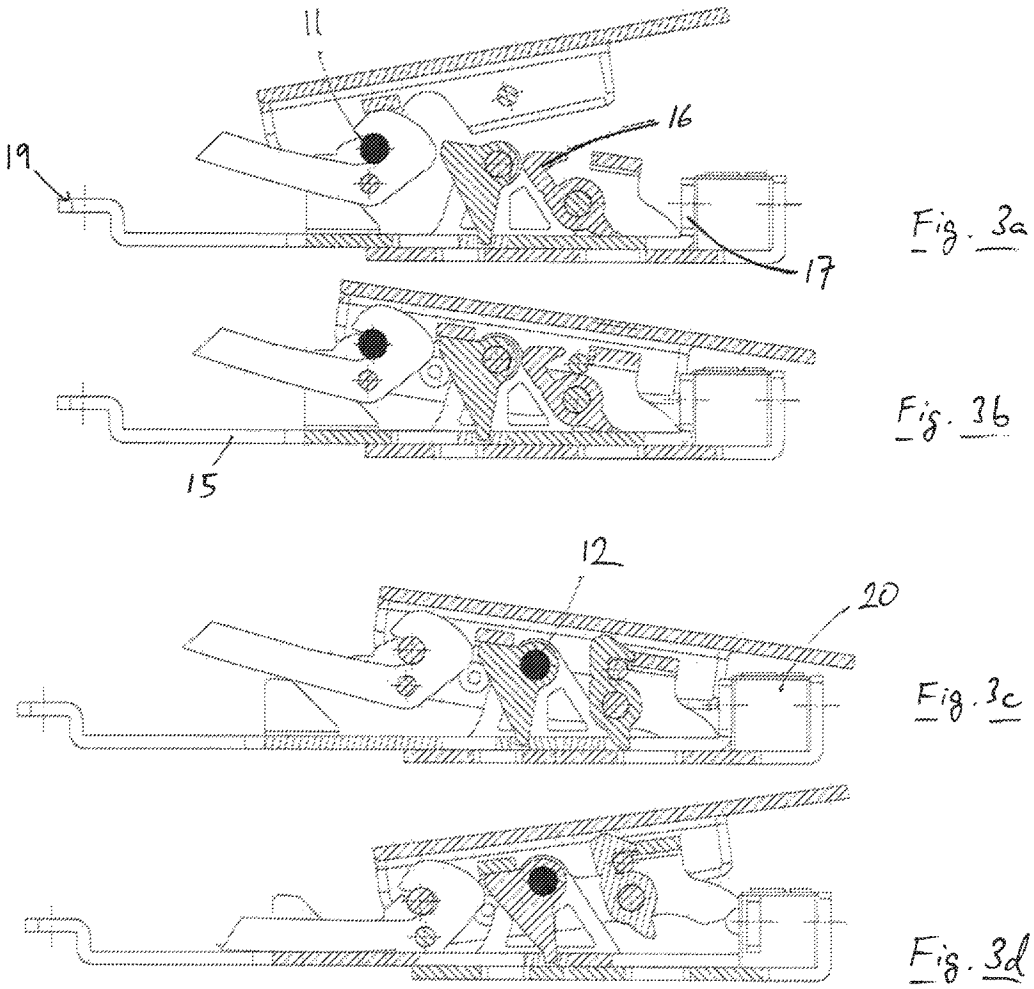
FIG. 3*a-d* shows a view of a different embodiment of the present invention in various usage positions.
Figure 4:
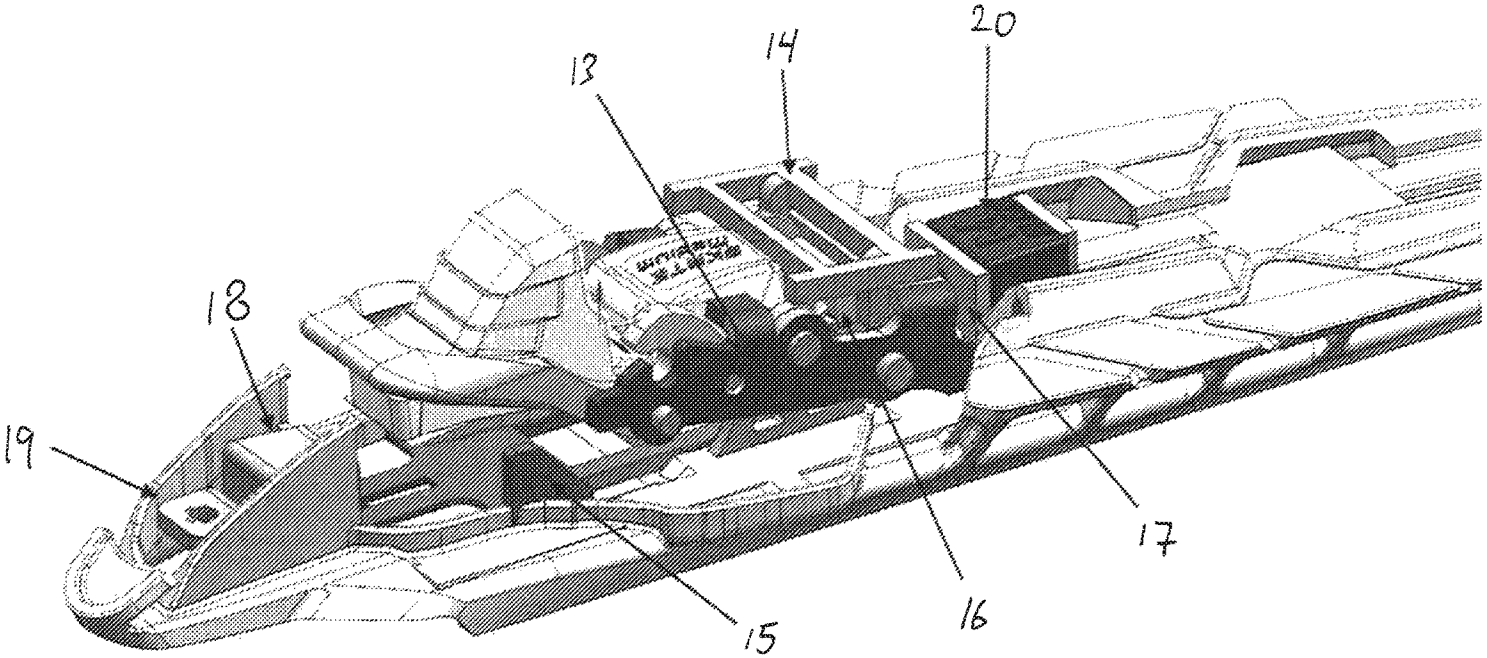
FIG. 4 shows a perspective view of an embodiment which resembles the embodiment in FIG. 3*a-c,*

FIG. 1*a-c* shows an embodiment of the present invention comprising an electrical and remote system 1 to change the position of a cross-country or touring binding 2 in the longitudinal direction. An electrical actuatable engine 3 is arranged such that is slides a binding on a ski forwards or backwards depending on an electrical signal which is given by an athlete.

Figure 6:
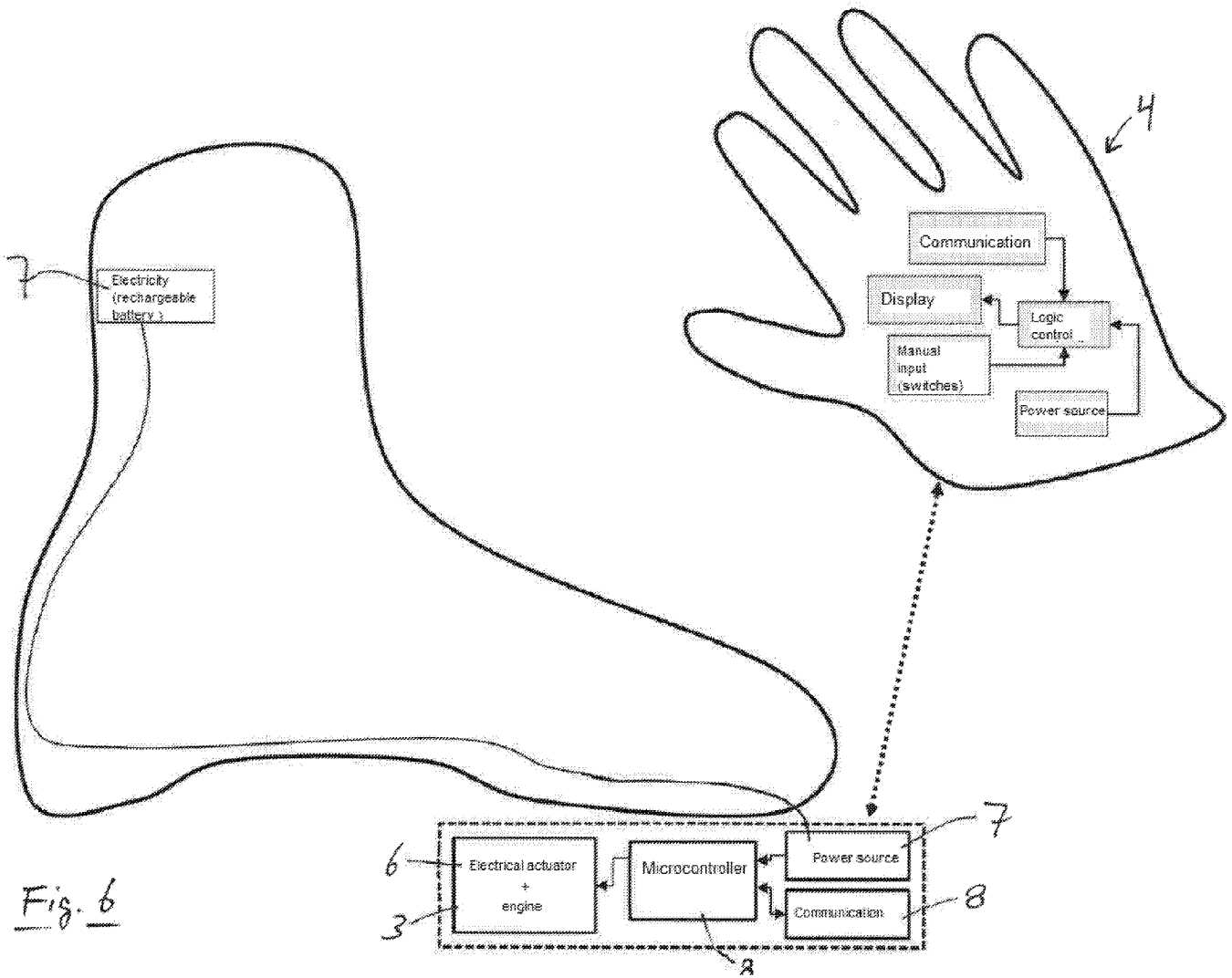
FIG. 6 shows how various functions and features may be distributed between a glove and ski boot.

The electrical signals may be provided by buttons, levers, switches, sensitive zones or corresponding members which for instance are arranged on a glove or a ski pole, ref. FIG. 6. Such members could then be said to constitute operating members. Other locations and actuation methods can also be contemplated. Three buttons could for instance be possible: «forward/good grip», «neutral/standard» and «backwards/good glide». The system can be discrete, i.e. have two or more predetermined positions, corresponding with those mentioned in the previous sentence. Alternatively, the system can be continuous, such that the athlete can adjust the exact position of the binding himself/herself. Which of the two solutions one would prefer is more or less optional with regard to the overriding principle, but it could have consequences for specific structural designs as well as the choice of electrical actuators.

In one embodiment the system can comprise a binding 2 which is movable in a groove or rail 5 on the ski, an electrical actuator 6 which either on its own or by its own electrical engine 3, pneumatic system, hydraulic system etc. is able to slide the binding 2 forwards and backwards between different longitudinal positions, an energy source 7 to run the electrical actuator 6, and a signal transponder or other communication member 8/microprocessor 8 which receives a signal, processes this and sends a signal on to the electrical actuator 6 which causes this to move the binding forwards or backwards.

Since major powers will be transferred from the athlete via the binding and to the ski, the system can comprise elements which locks the binding in the selected position when the electrical actuator has moved the binding (not shown). In this case, the locking member should be of such a nature that it can sustain the application of strong powers. Instead of separate blocking elements, the blocking elements can be a part of the electrical engine 3 or pneumatic system, hydraulic system etc.

The locking elements can have the form of a spring-loaded pin which may incorporate two, three or more different grooves or holes which are arranged on the ski or a plate which is mounted on the ski. The spring-loaded pin can be pulled out of a groove or hole by moving a double wedge-shaped plate in the one or other longitudinal direction. The wedge surmounts the power in the spring which pushes the pin down, whereby the pin can be pulled up. The wedge-shaped plate can on the one side be attached to an electrical engine 3, ref. FIGS. 1*a-c* and 2, via a biased spring 9 with sufficient power to push/move the binding forwards and backwards. Thus, the electrical engine 3 moves the binding indirectly by biasing the spring 9, as it is the spring power which pushes/moves the binding forwards or backwards. The spring 9 can be double-acting, i.e. acting in two directions, depending on which direction you wish to move the binding. The binding is arranged on the other side of or on the wedge-shaped plate. Thus, the binding runs freely on a rail 5, whereas the pin holds the binding in the desired position. The pin must therefore be sufficiently solid to sustain the power that is applied to the binding/ski by the athlete.

In a different embodiment it is the pin itself that is affected by an electrical actuator, e.g. a solenoid actuator which pulls up the spring-biased pin. A biased spring can then cause the binding to always be pushed forward as a kick from the athlete would be sufficient to surmount the biasing of the spring when the desired position of the binding is the rear position. In this embodiment the electrical system will only have two positions, such that the binding is either in «free» by the pin being pulled out of the holes or grooves, or «locked» by the pin being pushed down into one of the holes or grooves. In this embodiment it might be easier to only have two positions, «forwards/good grip» and «backwards/good glide», as the biased spring pushes the binding forwards when the pin is in free, whereas the athlete kicks the binding backwards (such that the biasing in the biased spring is surmounted) when the athlete so desires.

Instead of a pin, a lug, hook, tongue and groove, pairing pattern, clutch (friction-based engagement) etc. can be used as a blocking element. This applies both if the blocking element is separate from or integrated in the electrical engine or pneumatic system, hydraulic system etc.

Figure 5:
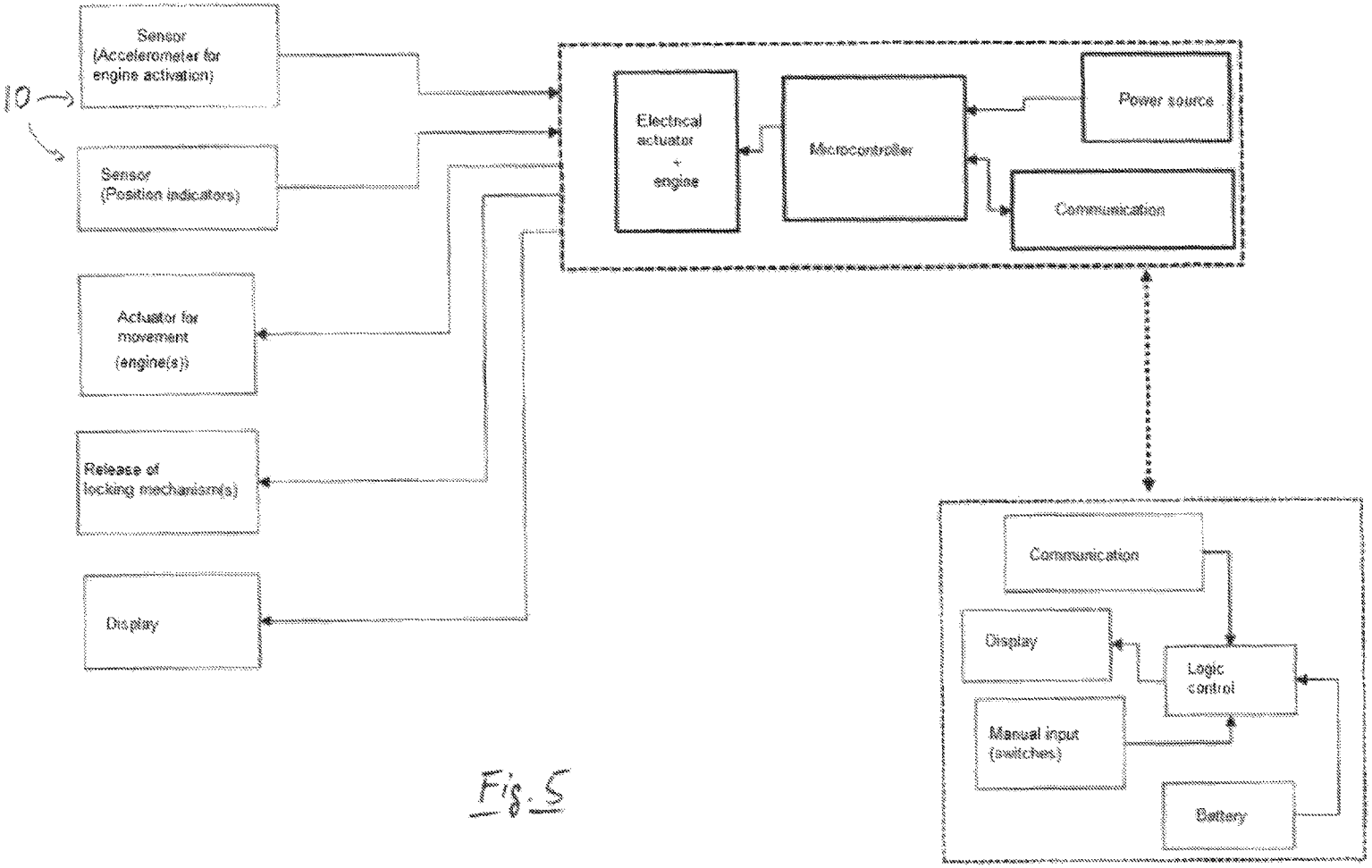
FIG. 5 shows schematic aspects of an embodiment of the present invention.

One or more sensors 10, ref. FIG. 5, in or in connection with the electrical actuator/engine 3 or pneumatic system, hydraulic system etc., can potentially sense and send a signal back to the transponder/microprocessor with information about the position and state of the binding.

All or parts of the various elements shown in the figures, i.e. the electrical actuator, one or more potential locking elements, one or more potential biased spring arrangements, power source etc. are arranged under, over or behind the binding 2. It will be understood that the various elements in the system according to the present invention, i.e. the electrical actuator, one or more potential locking and blocking elements, one or more potential biased spring arrangements, power source etc. can be arranged and distributed in several ways on or in the ski. The various elements in the system can be integrated in the ski or binding. The various elements in the system can be integrated in a closed and/or miniaturized system.

It will be understood that the system according to the present invention in most incidents should be sealed or protected from water intrusion. Intrusion of snow, ice and condensation can also constitute a problem which the system can or should be protected against. In order to mitigate condensation problems heating elements may be arranged on the inside of the completely or partly sealed compartments, e.g. in the form of resistance/hot wires which emit enough heat for the condensation to vaporize and escape from the system. One or more of the elements in systems, e.g. the biased spring or springs can in themselves constitute such resistance/hot wires. Such a drying process can be initiated automatically or manually in connection with the charging of the power source, i.e. preferably a battery.

With a view to the charging of the power source, this can be achieved by connecting a charger before of after use. The actuation system, which preferably, but not necessarily, is threadless, and which sends a signal to the electrical actuator on the ski, must also be charged at regular intervals.

In the above the binding system according to the present invention is described in relation to so-called diagonal gait or «classic» style, ref. FIGS. 1*a-c*, 2, 5 and 6. In this case it is the relationship between glide and grip which are affected by the binding system.

The binding system according to the present invention can also be used for so-called «freestyle» or skating. In this case the embodiment will be somewhat different. For skating the grip on the surface is not an issue, since only glide and power transfer matter. In order to achieve an improved transfer of power, a rotational point 11, 12 of the ski boot may be affected to achieve optimal power transfer in varying terrain. For instance, uphills it will be advantageous to move the rotational point of the ski boot backwards (12), such that the rotational point comes closer, or completely under, the ball of the foot. This gives a shorter «kick» corresponding to a «low gear», which make the climbing of hills easier.

Normally, the rotational point is located further ahead (11), approximately under the toes. When the rotational point is further ahead, the kick will be longer, something which will result in greater speed in flat or flatter terrain. This will correspond to a «heavier gear».

By positioning the rotational point for the «heavy gear» on the same place or further ahead than normal, as well positioning the rotational point for the «low gear» such that hills are climbed more easily, the speed will increase or the athlete's efforts will decrease.

Corresponding effects could be achieved by moving the rotational point up or down relative to the ski, or a combination between forward/backward and up/down. One can also wish to adjust the camber. These embodiments are not shown.

In the embodiment shown in FIG. 3*a-d* og 4 a cradle 13 is used onto which the ski boot 14 can be attached. The cradle 13 can be locked by means of a blocking element 15 which is actuated by means of an electrical actuator/engine (or other drive system, these are not explicitly mentioned hereafter, but is regarded as mentioned implicitly). When the cradle 14 is locked in position, the rotational point 11 will be moved forwards and one is in the «high gear». When the cradle is not locked in position, the rotational point 12 will be moved backwards and one is in the «high gear». It can also be the other way round. Several positions in-between may also be contemplated.

In the embodiment shown in FIGS. 3*a-d* and 4*a* number of other elements are also shown which may vary og may be omitted in other corresponding embodiments. In addition to the cradle 13, the ski boot 14 (or more precisely a bracket for interleaving in boot), rotational points 11, 12, and blocking element 15, various flexors 18, 20, clamping arrangements 20, locking arm for locking of boot 14 in the rear rotational point 16 are shown etc. The actual actuator and drive system, power sources, transponders are not shown in FIG. 3*a-d* og 4, but can in this embodiment push/pull the end 19, such that the actuator and drive system in itself can resemble the front part of what is shown in FIGS. 1*a-c* and 2. Other embodiments can of course be contemplated, and what has been shown in the figures are only examples, and must not be interpreted as limiting.

In the embodiments shown, these are primarily various types of cross-country bindings, i.e. racing, touring and mountain skis. It should however be understood that the present invention can give the same advantages and be equally relevant for alpine skis, randonee skis, telemark skis etc. By moving the bindings forwards or backwards «while moving» one will to a much greater extent be able to take advantage of some the skis' inherent characteristics. If the surface on which one is running is icy, steep and/or comprises many obstacles (trees, poles etc.) it could be an advantage to move the bindings forwards. This will provide a better grip on the surface and potentially also reduce the pivoting radius somewhat.

In the opposite case, by moving the binding backwards on an alpine, randonee, telemark ski etc., the ski will become more directionally stable, it will have a greater pivoting radius, improved bearing capacity in loosely packed snow and potentially greater speed on gliding surfaces. The present invention will therefore be equally suited for down-hill skiing without grip wax as for various types of cross-country skiing. The affected parameters can be said to be different, but the ultimate effect is the same: it will run faster and the athlete will experience a larger degree of control.

In the above-mentioned examples and embodiments a binding system is shown which is optionally adjusted by the athlete, i.e. that the athlete himself/herself decides which position the binding should have on the ski by sending a signal to the binding system, for instance by pushing buttons or the like on the glove or ski pole. A fully or semi automatic system may also be contemplated in which various sensors in the binding system retrieve relevant information, such as speed, angles, acceleration, force application etc. in order to calculate the optimal position of the binding, whereupon the moving of the binding takes place automatically. Such a system may be oversteered by manual buttons in the event that the athlete is not satisfied with the position of the binding.

The electrical actuator may also be adapted to cause a movement of one or more parts of the ski binding between various positions, e.g. blocking elements which causes a change of the ski boot's rotational point, locking elements which lock the entire or parts of the boot in a certain position (walking/driving mode, hard/soft surface, high/low speed etc.) and/or flexor elements (changing of the position, stiffness and flex curve of the flexor elements). Other manipulations of one or more parts of the ski binding in order to achieve a change in the ski's, binding's and/or ski boot's response or behavior may also be contemplated within the scope and spirit of the invention.

Various modes which may be affected can comprise one or more selected from the group comprising: walking mode, driving mode, resting mode, storing mode, charging mode, ice mode, powder snow mode, ideal snow conditions, electric saving mode, low speed mode, high speed mode, manual mode, automatic mode and/or default mode.

The default mode can be said to be a neutral setting which constitutes a compromise between all affectable positions and settings. First of all, the default mode can be considered to correspond to the positions and standings as a conventional ski/binding/boot would assume/have without the adjustment possibility. The system can go into the default mode when a battery level is low, ski poles are broken, the control unit(s) ceases to work, one or more functions or parts of the system cease to work as intended due to electrical, mechanical, control-related, temperature-related, humidity-related or other relevant conditions.

According to an embodiment of the invention, the default mode can be selected in advance, such that certain characteristics are emphasized when or if a battery level is low, ski poles are broken, the control unit(s) stops working etc.

In the event that the operating members are located on the ski poles, one can select to have a redundant system where both poles comprise operating members. The operating members on both poles will then be able to control the system. If one of the poles breaks, the other pole with the operating member will then control the system. In the event that both poles would break, the system will go into default mode, either factory settings or predefined by the athlete or service crew.

The invention claimed is:

1. A system for optional dynamic longitudinal positioning of the rotational point of a ski binding on a cross-country or touring ski during use, characterized in that that the system comprises:

an electrical actuator comprising an engine, an energy source for the electrical actuator, and a control system adapted to control the electrical actuator, wherein the electrical engine is adapted to move the rotational point by moving the ski binding, or parts thereof, when the electrical actuator receives a signal from the control system, wherein the electrical actuator, the energy source and the signal receiver are located at one of:

on the ski, in front of the binding;

on the ski, behind the binding;

between the ski and the binding; and in the ski.

2. A system according to claim 1, wherein the electrical actuator (6) comprises an electrical engine.

3. A system according to claim 1, wherein the electrical actuator (6) controls a pneumatic system.

4. A system according to claim 1, wherein the electrical actuator (6) controls a hydraulic system.

5. A system according to claim 1, comprising a blocking element (15; 16) which locks the binding in a selected position, the blocking element being adapted to be released when the binding is moved to a new position.

6. A system according to claim 1, wherein the binding is adapted to move steplessly between positions.

7. A system according to claim 1, wherein the binding is adapted to move between discrete positions.

8. A system according to claim 1, wherein the electrical actuator interacts with a biased spring, wherein stored energy exists in the biased spring in order to move the binding on or in the ski, the electrical actuator being adapted to bias the spring.

9. A system according to claim 5, wherein the electrical actuator is adapted to release and lock the blocking element.

10. A system according to claim 5, wherein another electrical actuator is adapted to release and lock the blocking element.

11. A system according to claim 9, wherein the blocking element locks or releases a cradle, wherein the cradle is adapted to change a ski boot's rotational point.

12. A system according to claim 5, wherein a biased spring is adjusted to move the binding to a default position when the blocking element is released, the electrical actuator being adapted to move the binding to a different position than the default position when the blocking element is released.

13. A system according to claim 5, wherein a biased spring is adapted to move the binding to a default position when the blocking element is released, the athlete's muscle power causing the binding to move to a different position than the default position when the blocking element is released.

14. A system according to claim 2, wherein the electrical engine is selected from the group comprising: step engine, linear motor, screw drive motor, telescopic engine, back-geared motor, magnet/solenoid switch.

15. A system according to claim 1, further comprising a sensor member selected from the group: accelerometer, gyroscope, pressure sensor, flexor sensor.

16. A system according to claim 10, wherein the blocking element locks or releases a cradle, wherein the cradle is adapted to change a ski boot's rotational point.

* * * * *